US010041242B2

(12) United States Patent
Yssel

(10) Patent No.: US 10,041,242 B2
(45) Date of Patent: Aug. 7, 2018

(54) TOILET FLANGE ASSEMBLY WITH COVER

(76) Inventor: Erika Yssel, Richmond, VA (US)

( * ) Notice: Subject to any disclaimer, the term of this patent is extended or adjusted under 35 U.S.C. 154(b) by 744 days.

(21) Appl. No.: 13/413,627

(22) Filed: Mar. 6, 2012

(65) Prior Publication Data

US 2012/0240319 A1 Sep. 27, 2012

Related U.S. Application Data

(60) Provisional application No. 61/457,405, filed on Mar. 21, 2011.

(51) Int. Cl.
*E03D 11/16* (2006.01)

(52) U.S. Cl.
CPC ..... *E03D 11/16* (2013.01)

(58) Field of Classification Search
CPC ..... E03D 11/16
USPC ..... 4/252.1–252.6; 138/89, 90
See application file for complete search history.

(56) References Cited

U.S. PATENT DOCUMENTS 3,570,021 A * 3/1971 Watson ..... 4/240
4,233,697 A * 11/1980 Cornwall ..... 4/252.4
5,329,971 A * 7/1994 Condon ..... 138/89
6,254,141 B1 * 7/2001 Piper ..... 285/56
6,615,413 B1 * 9/2003 Grant et al. ..... 4/252.1
8,443,844 B2 * 5/2013 Zeyfang ..... 138/96 R
2004/0034907 A1 * 2/2004 Malloy ..... 4/252.4
2005/0138722 A1 * 6/2005 Humber ..... 4/252.1
2010/0037376 A1 * 2/2010 Hughes ..... 4/252.4

FOREIGN PATENT DOCUMENTS

JP 05171673 A * 7/1993

OTHER PUBLICATIONS

JP 05171673 A English machine translation.*
VWVortex.com forum post, dated Aug. 16, 2006.*

* cited by examiner

*Primary Examiner* — Christine Skubinna

(57) ABSTRACT

A toilet flange is provided with a planar perimeter portion to assist the installer in accurately determining the distance to an adjacent wall as well as insuring the toilet fastening bolts are aligned parallel thereto. The toilet flange assembly includes a cover to store needed fastening elements while simultaneously preventing debris from entering the plumbing riser pipe. Additionally, a sleeve is provided that protects the threads of the toilet fastening bolts during construction and acts as an extendable flexible guide sleeve. The guide sleeve functionally extends the height of the toilet fastening bolt thereby assisting the toilet installer as a visual aid during installation.

17 Claims, 13 Drawing Sheets

TOILET FLANGE ASSEMBLY WITH COVER

CROSS REFERENCE TO RELATED APPLICATIONS

This specification claims priority of the provisional U.S. patent application Ser. No. 61/457,405 filed on Mar. 21, 2011.

FIELD OF THE INVENTION

The invention relates to plumbing fittings and more particularly it relates to a toilet flange assembly for facilitating connection of a toilet to a waste riser pipe.

BACKGROUND OF THE INVENTION

In residential and commercial building construction it is necessary to connect the base of a toilet, usually made of porcelain or similar material, to a drain pipe in a secure and water tight manner that meets all plumbing codes applicable in the local jurisdiction. The most common way of achieving this connection is to utilize a closet or toilet flange. The conventional toilet flange (1; FIG. 1) has a generally flat upper surface 3 and round perimeter surface 4 and includes at least one pair of semi-circular diametrically opposed arcuate key-shaped slots 2 which extend circumferentially 10 and allow for the insertion of toilet fastening bolts (9; FIG. 3) that are used to tighten the base of the toilet to the flange. Some toilet flanges include opposed radially extending slots 5 which cause the toilet fastening bolts 9 to be at a fixed position circumferentially but provide a means of removing, and possibly replacing at a later date, the bolt 9 radially along the slots as seen in FIGS. 1-3. As seen in the top view of FIG. 3, a conventional toilet fastening bolt 9 has a base with a major axis formed with two opposed extensions 9L,9R. Since the bolts 9 slide readily along the respective slots, all the tension force along the fastening bolts at the time of toilet installation is transferred solely from the opposed extensions 9L,9R to the area on either side of the slots as seen in each of FIGS. 1-3. This creates a pair of concentrated force areas on the toilet flanges but also results in instability in keeping the toilet fastening bolts 9 erect during installation. A further problem is making sure the opposed extensions 9L,9R are in the proper rotational position to maximize the surface area interaction. Early toilet flanges were made of cast iron and were connected to cast iron drain pipes. Modern closet flanges are typically made of ABS or PVC plastic and include a main cylindrical body portion 6 or collar that is solvent welded to a drain pipe riser (not shown) of a similar plastic and an attachment flange portion 7 that extends radially from the upper end (11; FIG. 2) of the main cylindrical body portion 6 and is bolted to the base of the toilet.

A significant problem faced by plumbers during installation of the toilet is aligning the toilet fastening bolts 9 with the holes in the base of the toilet since the bolts are non-fixedly mounted to the toilet flange. Each fastening bolt, as shown in FIG. 3, is typically held in place with a plastic push-on bolt stabilizer (such as that disclosed in U.S. Pat. No. 7,950,886) which are slipped-down the toilet fastener bolt 9 to assist it in standing erect relative to the flange. The conventional toilet fastening bolts 9 are non-fixedly mounted for three reasons. The first is that the circumferential slots 2, which are most typical, allow for circumferential adjustment 10 of the bolts and thus the toilet as it is being lowered onto the flange. This provides a method to make sure the back of the toilet is set parallel to the nearest finished wall providing the most pleasing appearance. The second reason the toilet fastening bolts 9 are non-fixedly mounted, and thus loose fitting, is that if the toilet installer hits the fastening bolts during installation he may either chip the porcelain on the toilet base, bend the toilet fastening bolt or crack the toilet flange if the bolts were rigidly mounted. It is not uncommon for a toilet installer to knock-loose the fastening bolts 9 as he is lowering the toilet onto the wax ring (not shown) and toilet flange because the push-on bolt stabilizer is pliable and the toilet fastening bolt itself is not fixed relative to the slot 2. Once the toilet is set against the wax ring it generally cannot be removed without the possibility of future leakage. The third reason is that there are currently code requirements in some jurisdictions that dictate a design with the ability to service/replace the entire bolt assembly.

A further problem continually faced by plumbers involves the prevention of clogging of toilet drain pipes during construction due to the fact that the toilet flanges are mounted to the plumbing riser pipes long before the toilet is installed. Saw dust, fasteners, woodchips, tile, adhesives and various other construction debris fall into the drain pipe riser and cause major blockage after the newly completed building is occupied. Plumbers are known to use cloth, plastic, tape or a combination thereof as temporary covers or plugs in the riser pipe and toilet flange during construction. However these temporary plugs, such as a gathered rag, also capture debris and as they are removed it is common for construction debris to still make its way into the pipe riser. Furthermore, plumbing codes require either a liquid fill test or pressure testing of the drain system at the time of rough-in inspection to detect leaks. Therefore, it is necessary to provide access to the riser drain pipe to fulfill the testing requirement for rough-in inspection approval. Mechanical and nomadic test plugs are also quite often used to run the test. A recent proposed modification to toilet flanges to prevent debris has been to incorporate a knock-out plate 8 in the flange riser opening (FIG. 1). However, these knock-out plates 8 have shattered at the time of removal thus themselves become debris which may fall down the drain pipe. Also once the frangible connection of the knock-out plate is broken the shattered plate can no longer seal the pipe and cannot be reinstalled. To perform the code-required liquid fill test or a pressure test the knock-out would need to be removed so that water can be added to the riser pipe. The rough-in plumbing test conventionally requires a visual inspection of the water level, to make sure it remains unchanged, after 24 hours. Only if the water level is unchanged can it be verified that water leakage is not occurring in the system. If the riser pipe is left open after the rough-in plumbing inspection test then additional debris can find its way into the riser pipe once again during tiling work, which takes place after the test.

Another issue with conventional toilet flanges 1 is that they require a fastening assembly for securing the toilet to the flange which includes at least a pair of toilet fastening bolts, nuts, washers as well as a pair of push-on bolt stabilizers. These fastening elements of bolts, nuts, washers and bolt stabilizers are separate loose elements. Since they are loose elements they are either purchased separately or sold with the flanges and stored. If they are purchased with the flange it is not unusual for some or all of these stored fastening elements to go missing during the construction phase since it is usually months between the time the flange is installed and when the fastening elements are needed to secure the toilet.

Yet another issue with conventional toilet flanges is that they are designed with multiple keyed slots 2/5 for the toilet fastening bolts to fit into, in excess of just the pair needed, and this weakens the integrity of the flange. It is conventional to have the toilet flanges circular in design wherein the only considerations for orientation about the riser pipe are the keyed slot locations 2/5 for the toilet fastening bolts 9 and the positioning of the fastening apertures 12 to secure the flange to the floor. When mounting the toilet flanges on wood floors, it is best if the fastening apertures 12 for the flange can be oriented directly above floor joists so that the wood screws that secure the flange to the floor also bite into the floor joists beneath the plywood flooring.

Another issue with conventional toilet flanges, especially those without knockout plates, is that the center of the riser is not clearly identified although this measurement is critical in spacing the center of the toilet flange relative to the closest finished wall surface. Most toilets need to be spaced either twelve or fourteen inches from the centerline of the toilet flange or riser pipe to the finished wall surface.

SUMMARY OF THE INVENTION

It is the object of the present invention to form a toilet flange with several improvements over conventional toilet flanges. One aspect of the invention is to form a toilet flange with a removable cover wherein the cover performs multiple functions. The removable cover forms a storage compartment for the toilet fastening assembly elements. It also removably blocks the opening of the riser pipe to keep debris from entering the riser pipe when the cover is in place. The cover includes geometric indicators which define the centerline axes of the flange. The cover includes raised aligned spaced tabs which function as a backstop for placing a straightedge to more clearly define a parallel orientation to a finished wall surface. The raised tabs also function as elements onto which a measuring tape can be hooked to clearly measure the distance from the centerline to the finished wall surface. And, the cover functions to keep debris out of the openings into which the toilet fastening bolts will be threaded. The cover also interlocks with the fastening nuts into which the fastening bolts will be inserted. The cover interlocks with the nuts by hook-type flared end portions on the end of the male projections which are inserted into the nuts. This hook-type feature more securely retains the nuts to the flange during shipping and prior installation. By having a storage compartment built into the toilet flange cover the fastening assembly, which may include a pair of toilet fastening bolts with protective sleeves, fastening nuts and washers, is readily located when needed at the time of toilet installation. The removable cover blocks any debris from entering the riser pipe during the construction phase. The cover is easily removable, with the assistance of pry point recesses, for access to the riser drain pipe for verifying visually the water level within the riser pipe. The cover is also easily reattached after testing is completed by merely aligning the male projections formed on the underside of the cover with the toilet fastening bolt openings. In this manner the male projections now retain the nuts in place being centered and in alignment with the openings into which the fastening bolts will be inserted.

Another aspect of the invention is the toilet flange itself is formed with a straight portion along the perimeter outer surface so that the installer can readily determine when the toilet fastening bolts are aligned parallel relative to the finished walls near the toilet flange installation. The straight portion is symmetrical with respect to the two toilet fastening bolt openings. By making this straight portion parallel to the finished wall surface, in combination with flexible sleeves (discussed hereinbelow), there is no longer a need for any circumferential or radial slots in the toilet flange and there is no worry of chipping of the toilet base. No circumferential or radial adjustment is needed relative to any finished wall surface since the straight portion is parallel to the rear of the toilet tank and thus parallel to the finished wall surface and there is a clear indication in both directions of the distance to any wall. Since no adjustment of the toilet fastening bolt location is needed the slots in the top surface of the flange are replaced with a single pair of openings into which the toilet fastening bolts are inserted. This improved toilet flange configuration allows the flange screw apertures, for securing the flange to a floor surface, to be spaced further radially than conventional toilet flanges because the integrity of the flange is higher with less openings in the top surface. By spacing the flange screw apertures further apart the flange is more rigidly secured to the floor. Fastening the toilet flange more securely to the floor means a greater rocking force of the toilet would be required to dislodge the flange. This design further allows the floor joists to be spaced further from the riser pipe allowing easier access for securing the toilet flange to the riser during construction. It further allows the flange screws to bite into the floor joists beneath the plywood flooring. The preferred embodiment provides a reduction in the number of toilet fastener bolt locations to just the two needed. This increases the structural integrity of the toilet flange and saves manufacturing costs.

Another aspect of the invention is that each of the toilet fastening bolts is provided with a brightly colored disposable fitted sleeve that performs a double function. During the construction phase the sleeve provides an additional cover to keep the bolt threads clean while they are stored within the removable cover. During the time of toilet installation the sleeve is extended up to act as a flexible guide for the installer to align the bolt through the toilet base opening. The sleeves are flexible, disposable and brightly colored thus providing a bright contrast so that the toilet installer has a visual aid in aligning the openings in the toilet base with the flexible brightly colored sleeves. The fitted extendable sleeves nearly visually double the length of the toilet fastening bolts thus allowing the toilet installer twice the height off the floor to align the toilet base openings with the toilet bolts. The flexible sleeve eliminates the possibility of chipping the porcelain toilet base, of bending a toilet fastening bolt due to the toilet swinging motion during initial line-up and prevents toilet flange fracturing. The fastening bolt itself is also not rigidly connected to the toilet flange but is held securely erect by the threaded nut which acts as a purchase held firmly to the underside of the radial portion of the flange.

A further benefit of the invention is the elimination of one of the loose fastening elements. The invention eliminates the need of push-on bolt stabilizers.

And yet another benefit of the invention is the elimination of the conventional toilet bolt which has opposed extensions. The invention uses a square nut to secure the toilet bolt which provides greater surface area to transfer the tensile force to the toilet flange and also functions to hold the toilet bolt erect during installation.

DETAILED DESCRIPTION

Figure 1:
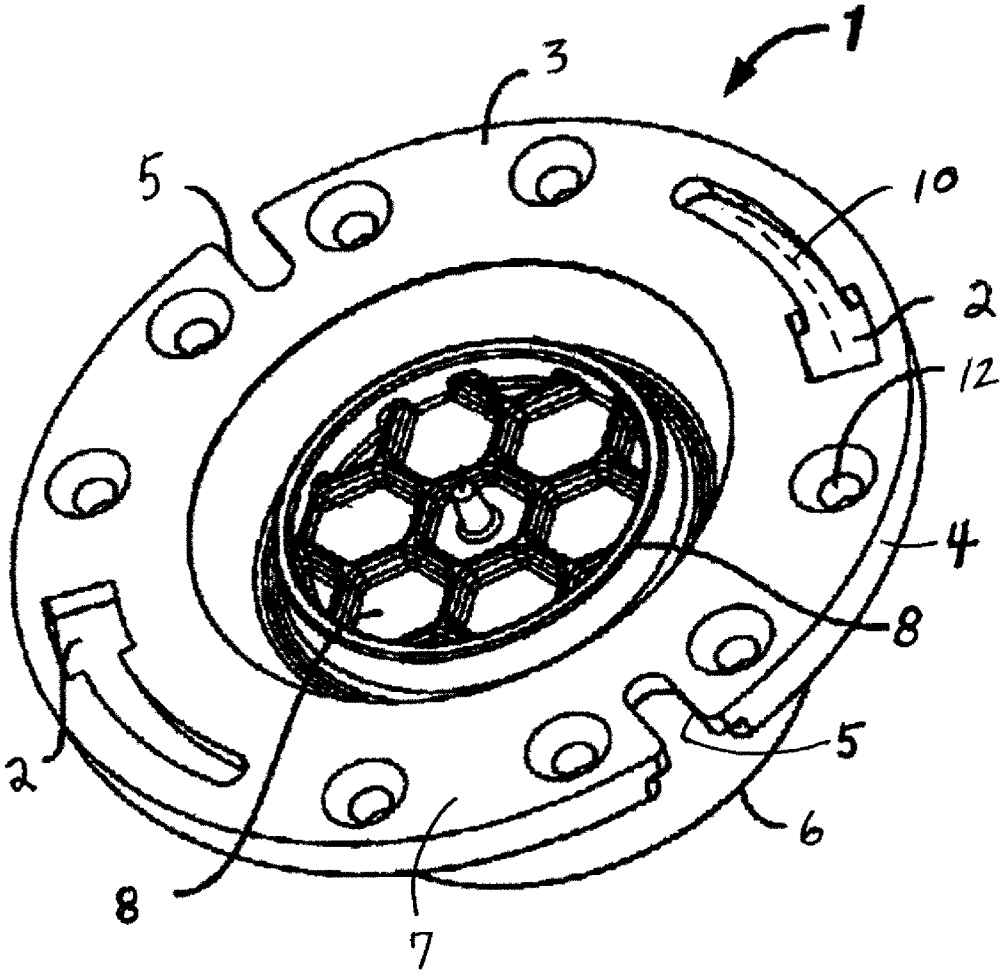
FIG. 1 Prior Art
FIG. 1 is a top view of a conventional toilet flange.
Figure 2:
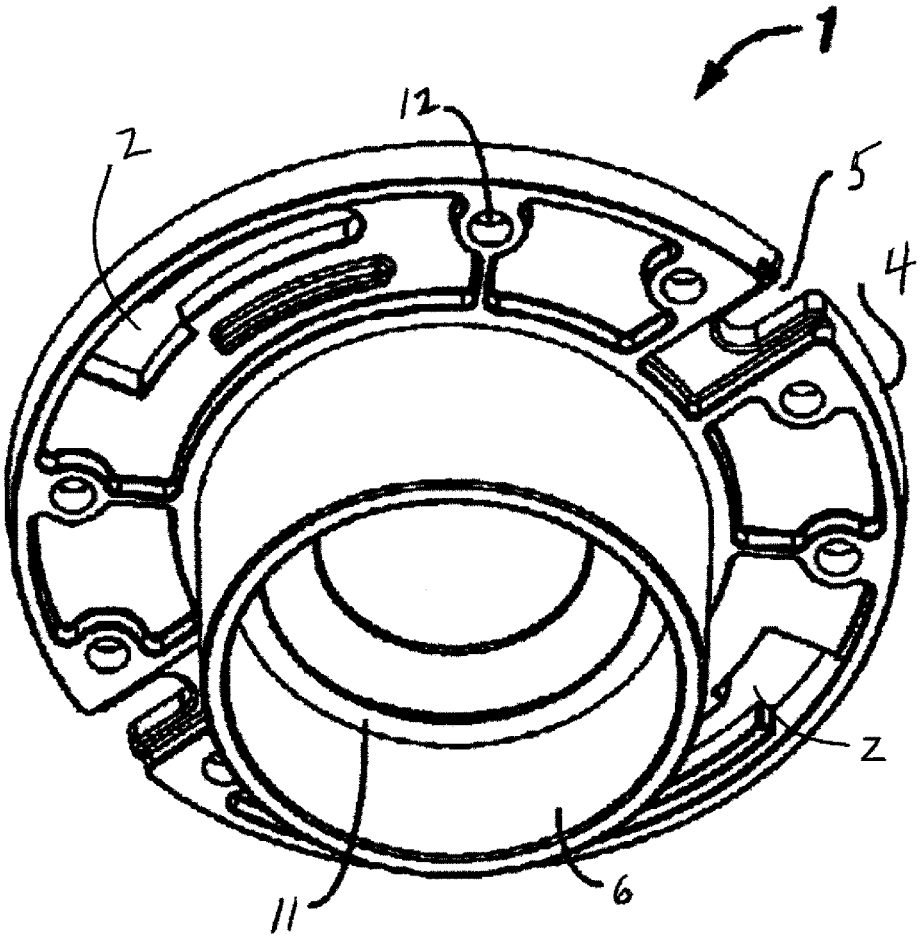
FIG. 2 Prior Art
FIG. 2 is a bottom view of a conventional toilet flange.
Figure 3:
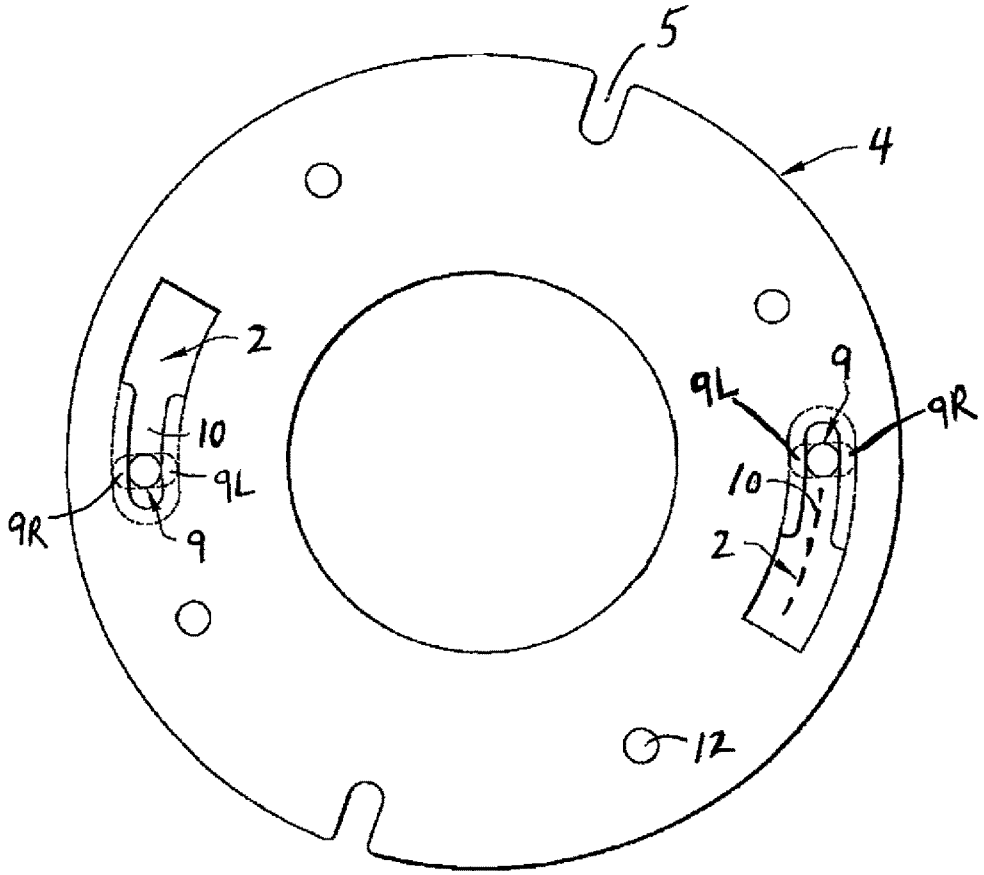
FIG. 3 Prior Art
FIG. 3 is a top view of a conventional toilet flange with conventional toilet bolt fasteners installed.
Figure 4:
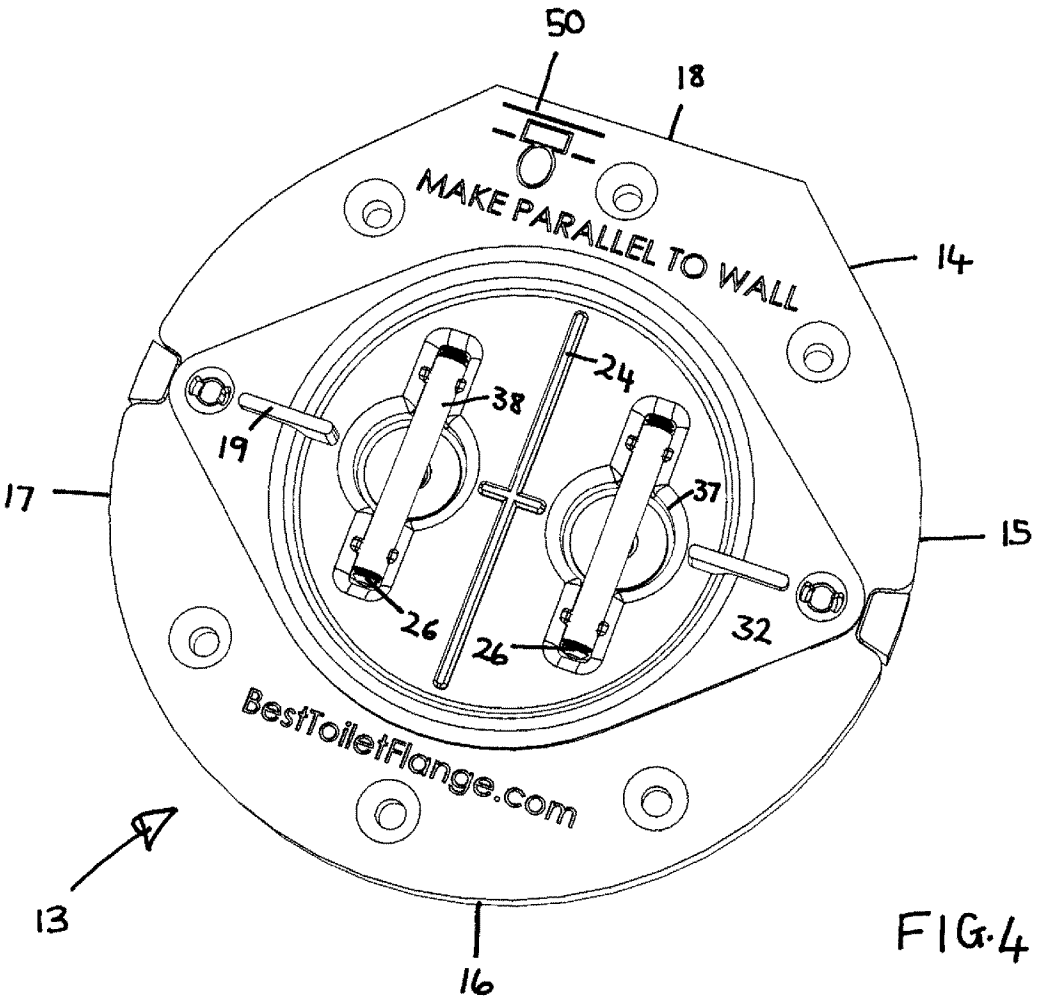
FIG. 4 is a perspective view of a preferred embodiment of the toilet flange assembly.
Figure 5:
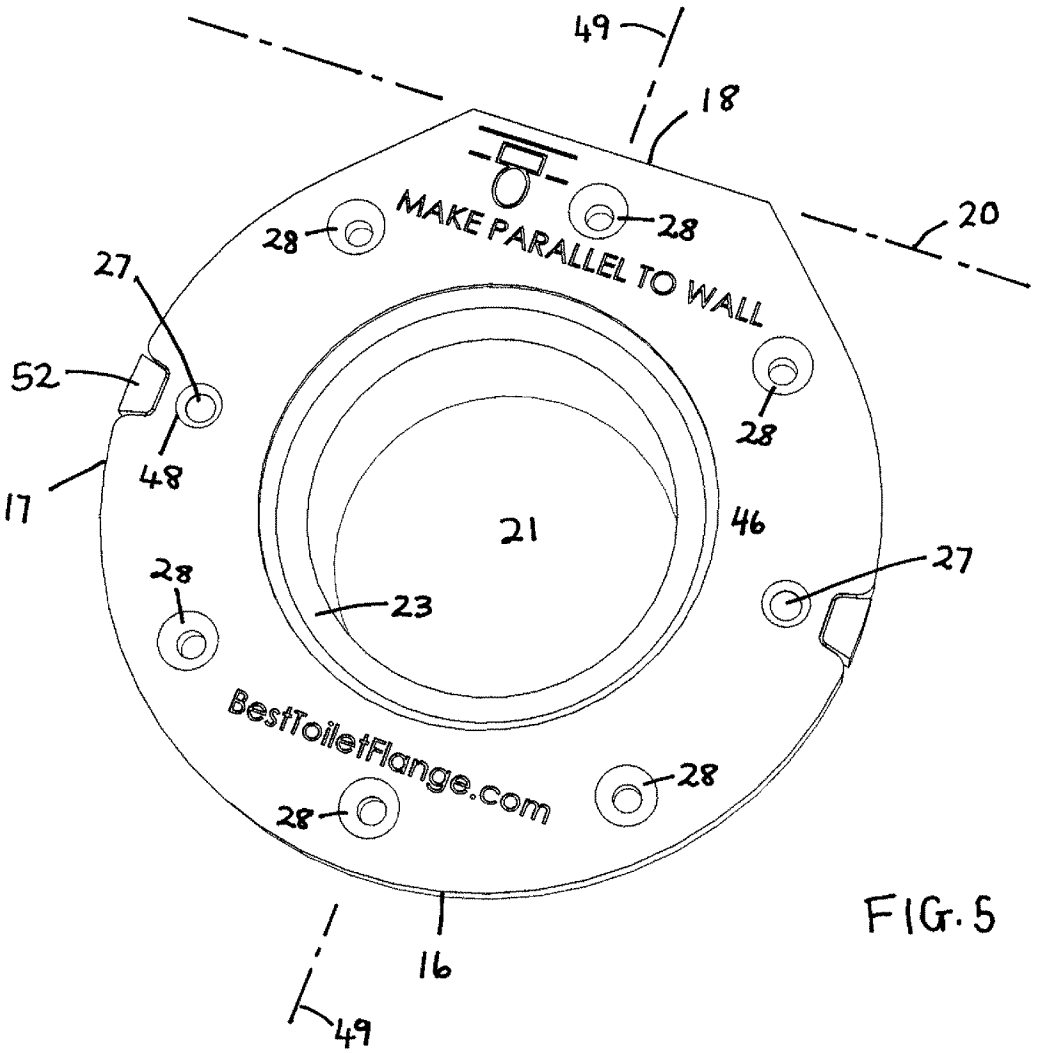
FIG. 5 is a top view of the toilet flange of FIG. 4 with the cover removed.
Figure 6:
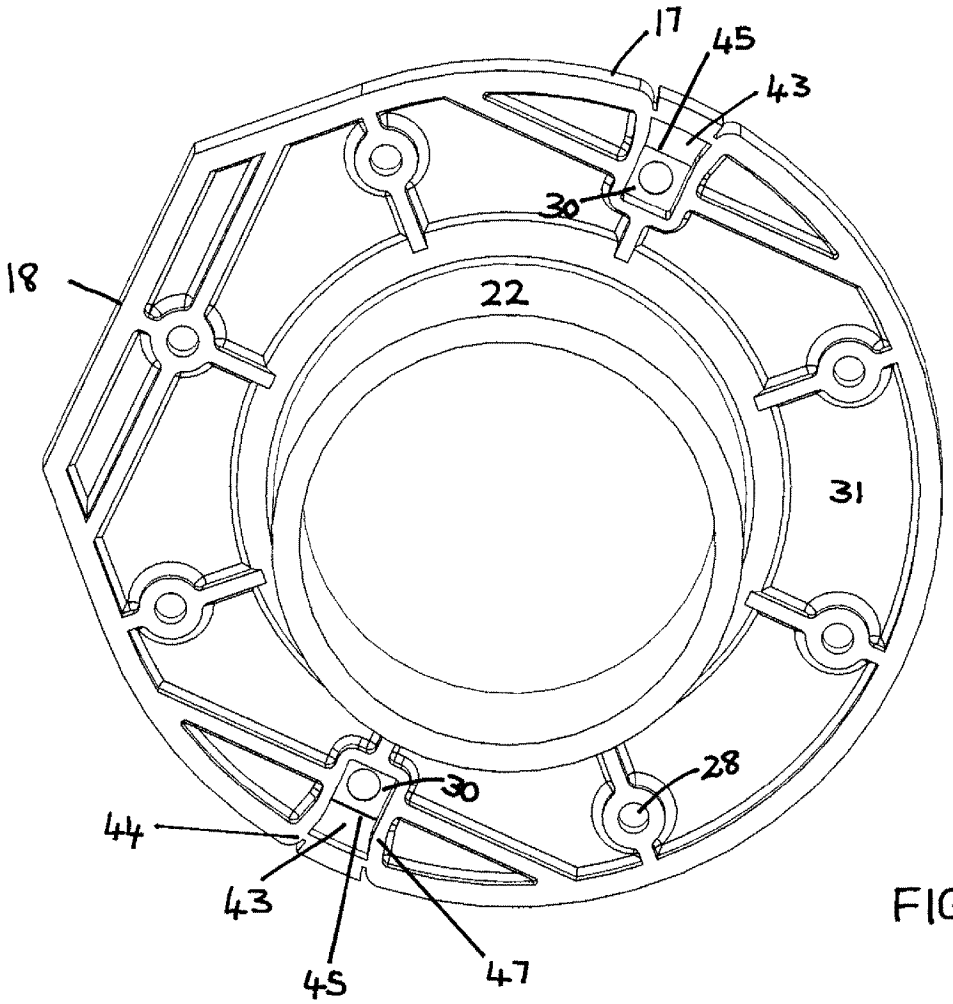
FIG. 6 is a bottom view of the toilet flange of FIG. 5.

Referring to the drawings, wherein like reference numerals are used to designate like parts, FIG. 4 shows a preferred embodiment of the closet or toilet flange 13 in accordance with the present invention which comprises a body having an outer perimeter surface 14 which is shaped with rounded perimeter side portions 15, 16, 17 and at least one perimeter straight surface portion 18. The straight surface portion 18 is also planar in the plane perpendicular to the subfloor onto which the flange is secured so that a straightedge 55, such as a conventional level, can be abutted against the planar straight surface 18 to function as a visual aid (FIG. 11) in extending the line 20 (FIG. 5) of the straight portion 18 parallel to a future finished wall surface. The radial dimensions of the toilet flange are sized so that the perimeter rounded side portions 15-17 and the straight surface portion 18 properly fit within the recess of a conventional toilet base (not shown). Unlike conventional toilet flanges that are round as seen in a top view of FIG. 1, the straight surface 18 of the instant invention benefits the installer in that it allows the installer to rotate the toilet flange such that straight surface 18 is parallel to the back wall of the toilet tank which is most commonly parallel to the future finished wall which is in juxtaposition to the tank. FIG. 4 shows on the top surface the notation "make parallel to wall" and a universal illustration 50 as clear visual indicators for even the novice installer. It is noted that it is important that the straight surface of the toilet flange needs to be spaced a distance far enough from the finished wall to provide adequate space for the toilet tank but not too far so that there is too large a gap behind the tank resulting in a less favorable appearance. That proper distance is a design element of the toilet manufacturer and is normally twelve or fourteen inches. The toilet flange is provided with an insertion collar 22 (FIG. 6) which is secured to the riser pipe (not shown) and includes a sloped surface 23 formed in the toilet flange. The additional benefit of having a perimeter straight surface 18 on the toilet flange 13 is that it eliminates the need of having toilet fastener slots since no circumferential or radial adjustment of the toilet fastening bolt location is needed. The elimination of the slots, as seen in the conventional flange of FIG. 1, now provides the opportunity of having fixed openings 27 into which the toilet fastening bolts 26 will be inserted. The elimination of the excess openings increases the integrity of the toilet flange. This results in cost savings in the manufacturing process with material selection, thickness and reduced production time. Since the straight surface 18 is parallel to the back wall of the toilet tank the fasteners 26 will be in the exact location needed for the future placement of the toilet when the toilet is properly seated against the toilet flange.

Yet another benefit of having the toilet flange not round is that the apertures 28 for the flange screws are spaced radially further from the riser pipe opening 21. This allows the screws (not shown) that secure the flange to a wooden floor to not only grab the subflooring but to further grab into the floor joists (not shown). The benefit of having the flange screw apertures 28 spaced further radially from the riser pipe is that the floor joists beneath the plywood can also be further spaced thus allowing better air circulation and easier access for plumbers and framers. A similar benefit is recognized when the flange is installed in concrete flooring. By having the apertures 28 spaced further from the riser pipe the integrity of the concrete itself is protected. It is not uncommon for concrete to shatter when drilling the four holes needed to secure the toilet flange onto the concrete slab with conventional toilet flanges because the apertures are so close to the edge of the concrete that is formed where the riser pipe comes through the concrete pour. By spacing the apertures farther from the edge of the concrete, formed due to the riser drain pipe, the integrity of the concrete is maintained and fracturing of the concrete is essentially eliminated. This also allows for longer flange screws/bolts to be used as well as thicker flange screws/bolts to be used for greater integrity since the apertures are spaced a greater distance from the edge of the concrete.

Figure 7:
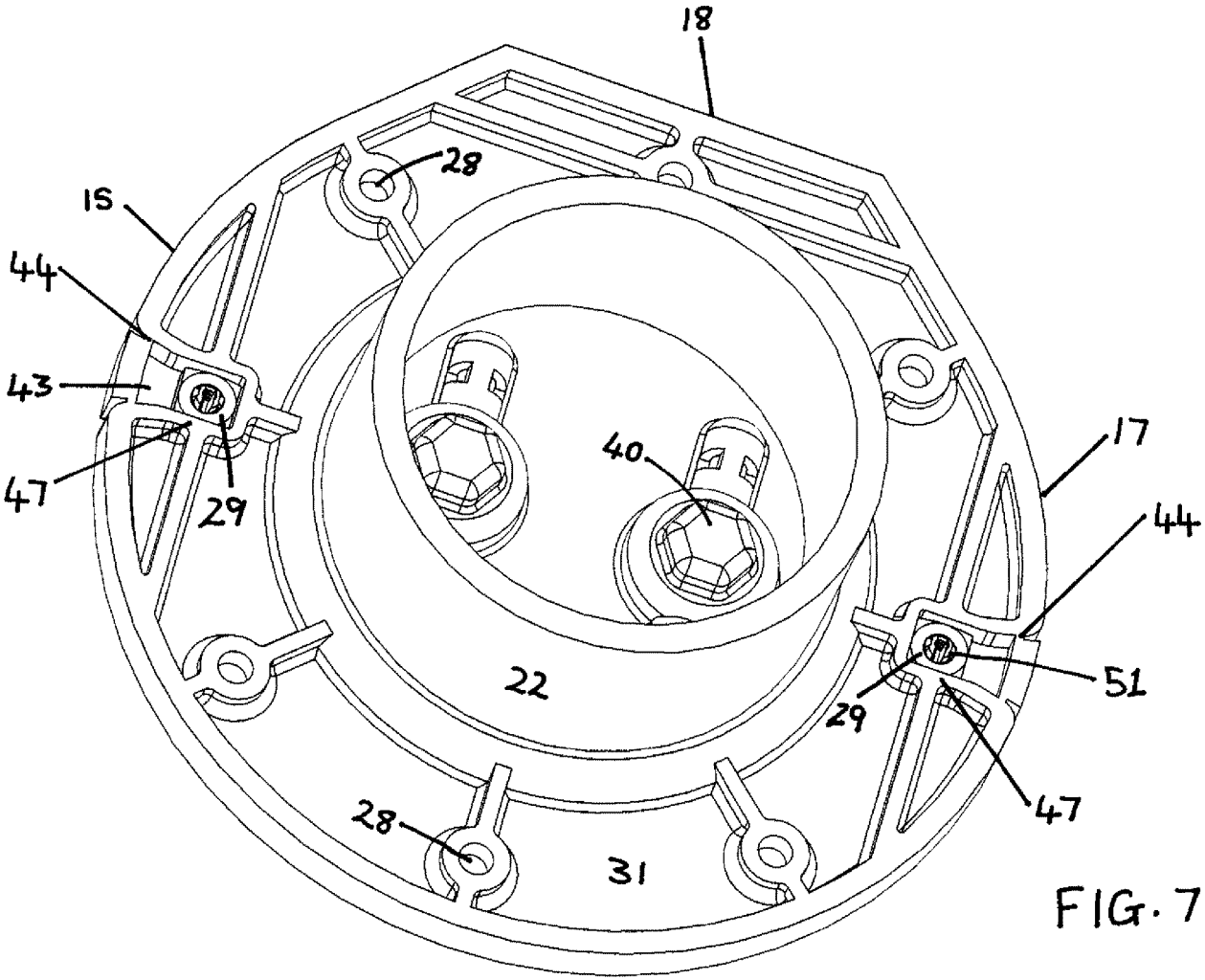
FIG. 7 is a bottom view of FIG. 1 with cover secured to the flange.
Figure 12:
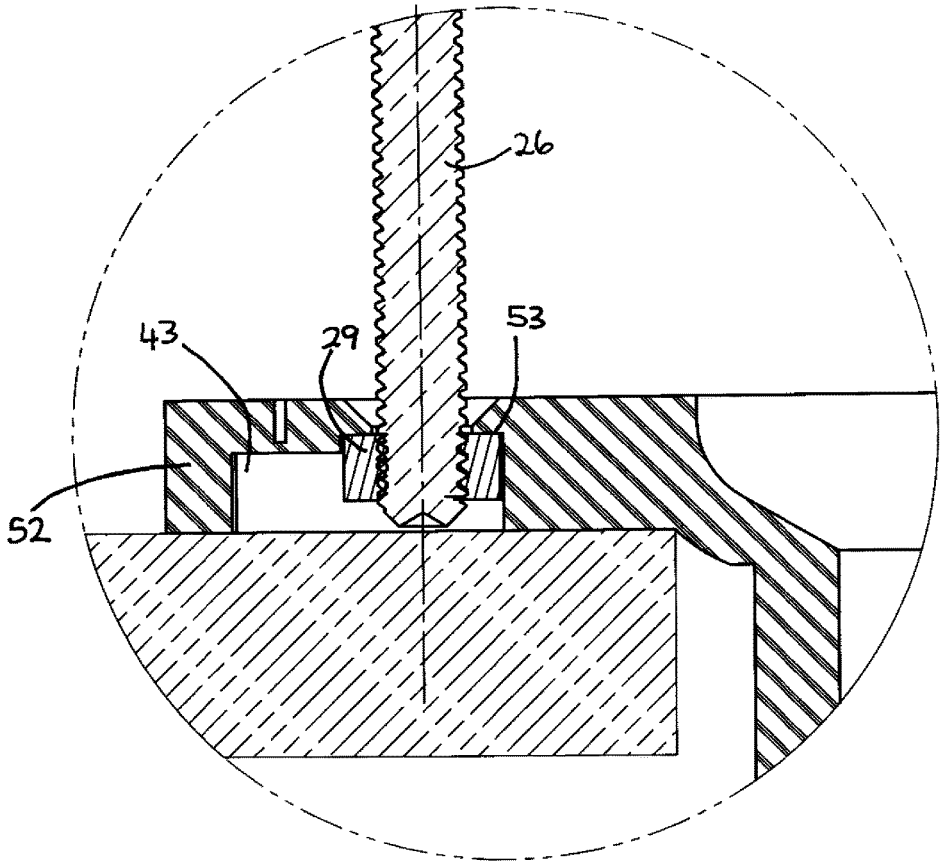
FIG. 12 is a side view of the nut recess and slot
Figure 13:
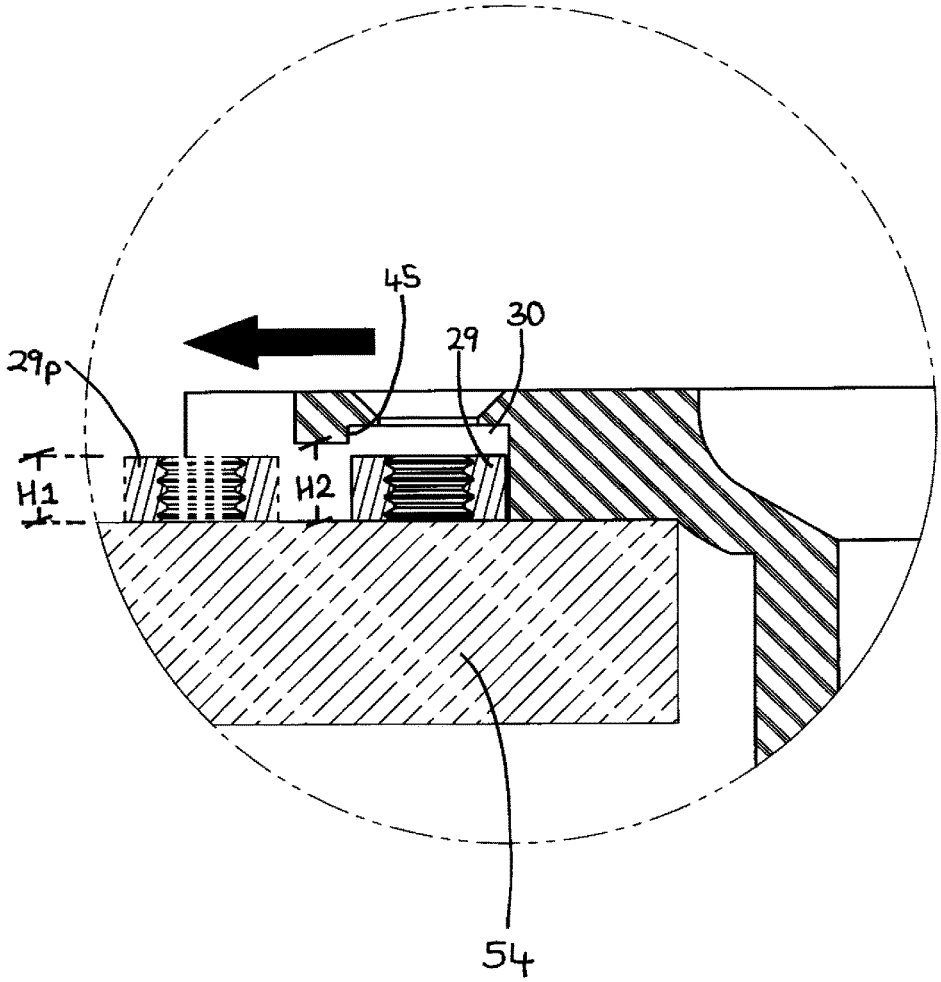
FIG. 13 is a side view of the nut recess and slot with the removable element removed allowing for the nut removal.

FIG. 7 shows a fastening element 29 inserted into a recess 30 formed on the underside of the toilet flange radial portion 31. The preferred fastening element is a rectangular nut 29 with the central axis of the threads of the nut being aligned and thus coaxial with the central axis of the toilet fastening bolt opening 27. The recess 30 is formed on the underside of the toilet flange in continuation of a slot 43. The purpose of slot 43 is to allow removal of a nut 29 at a future date for replacement if needed. If a non-corrosive nut is used then the slot feature is not needed, unless required by code, and a four sided recess matching the rectangular shape of the nut could be used. The depth of the recess is greater than the height H1 of the nut as shown in FIG. 13 thus allowing vertical clearance in case the subfloor, onto which the flange is secured, is more rough than planar. The greater height of the recess also serves the function of allowing a hook-type end 51 of a male projection 34 to pass completely through the nut and flare out to grab the underside of the nut to fixedly interlock the nut to the flange during shipping, as discussed hereinbelow. The width of the slot 43 is also slightly wider (FIG. 6) as is extends radially from the recess 30 to provide ease in removing the nut 29 as illustrated in phantom 29*p* in FIG. 13. It is noted that a smaller rib or wall 45 may be integrated into the underside of the flange. This would provide an additional partial fourth wall such that the recess retains the rectangular nut on all four sides and thus able to counteract a higher degree of torque. The height of the smaller rib/wall 45 would not be such as to restrict the nut from passing under and out the slot 43 as shown in FIG. 13. Thus the clearance height H2 between the bottom of the rib 45 and bottom-most plane of the flange is greater than the height H1 of the nut. A benefit of having the recess 30 deeper than that of the nut height is that the sides 47, which actually define the recess 30 and slot 43, are also taller. The taller sides 47 are actually structural ribs which strengthen the integrity of the flange. The benefit of having the nut rectangular in shape is that it can accept a high degree of torque from the fastening bolt in a rectangular cavity before reaching plastic deformation of the sidewalls 47. An additional benefit of having the rib sidewalls 47 taller than the height of the nut is that air is able to pass under the nut as seen in FIG. 12 to avoid any future corrosive action due to liquids that may find its way under the toilet flange.

Preferably there will be a removable element 52 having at least one very thin wall 44 at the outermost end of the respective slots 43. The removable element 52 can be cut or snapped-out of the respective outer walls 15/17 of the flange at a future date if servicing of the nut 29 is needed as shown in FIG. 13. These removable elements 52 will keep debris out of the slots 43 during the construction phase. Unlike conventional toilet bolt fasteners that had only opposed extensions to transfer the tensile load, a rectangular nut has greater surface area to interact with the flange since all four corners of the nut engage the underside of the flange and all four corners of the nut are in juxtaposition to the ribs 45/47. The nut will be held in place by friction between side walls of the nut 29 and side walls of the recess 30 as discussed hereinbelow. The nut 29, even if dislodged from the frictionally held position, will travel vertically along the bolt 26 as the toilet fastening bolt 26 is being threaded. The underside surface of the flange functions as a purchase 53, as shown in FIG. 12, to hold the fastening bolt erect.

Figure 8:
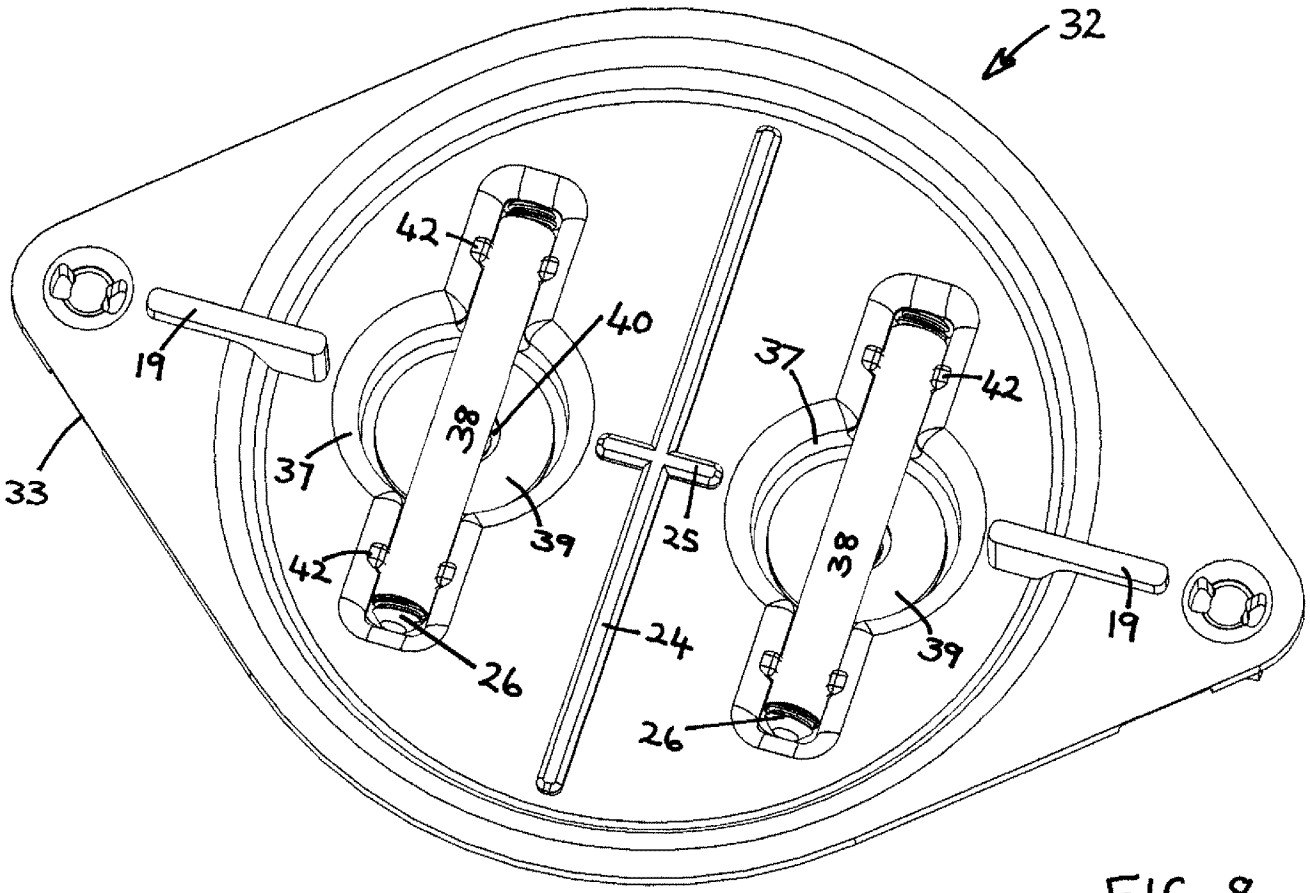
FIG. 8 is a top view of the toilet flange cover of FIG. 4 detached from the toilet flange.

FIG. 4 shows a second part of the flange assembly being a cover 32. The removable cover 32 performs multiple functions. The removable cover includes a pair of storage compartments 37 for the toilet fastening assembly elements. It also removably blocks the opening 21 of the riser pipe to keep debris from entering the riser pipe when the cover 32 is in place. The cover includes markings 24/25 which define the centerline axes of the flange. The cover also includes raised aligned spaced tabs 19 which function as a backstop for placing a straightedge to more clearly define a parallel orientation to a finished wall surface. The raised tabs 19 also function as elements onto which a measuring tape can be hooked to clearly measure the distance from the centerline to the finished wall surface. The cover 32 further functions to keep debris out of the openings 27 into which the toilet fastening bolts 26 will be inserted. By having a storage compartment 37 built into the toilet flange cover the fastening assembly, which may include a pair of toilet fastening bolts 26 with protective sleeves 38, washers 39 and nuts 40 (positioned beneath the washers 39; FIGS. 7 and 8), is readily located when needed at the time of toilet installation. The removable cover 32 blocks any debris from entering the riser pipe during the construction phase. The cover 32 is easily removable, with the assistance of pry point recesses 33, for access to the riser drain pipe for verifying visually the water level within the riser pipe. The cover 32 is also easily re-attached after testing is completed by merely aligning the male projections 34 formed on the underside of the cover 32 with the toilet fastening bolt openings 27.

Since manufacturing tolerances of both the nut 29 and recess 30 can vary slightly the nut 29 is not only held in place by friction but the nut is further held in place by retaining elements formed on the cover. Initially the hook-type ends 51 of the male projections 34 interlock with a bottom surface of the nut 29 thereby securing the nut to the flange for shipping and installation (FIG. 7). At the time the cover 32 is detached from the flange for filling the riser pipe with water the nut will be released from the male projections 34. The nut 29 is designed to be retained by friction with the sidewalls 47. However, it is also understood that there is a possibility that the nut may become dislodged from the sidewalls if the frictional force is less than ideal due to tolerances of a nut 29 or due to workman actions while attaching the flange to the flooring. For example, the use of a hammer drill during the installation process of securing the flange screws to the floor may cause the nut 29 to be knocked loose. Since the flange is secured to the floor, the nut 29 if loosened from the sidewalls 47 and/or hook ends 51, will merely drop vertically but remains retained within the recess 30 by both the male projections 34 and the floor as the cover 32 is removed. The male projections 34 are of sufficient length such that the hook ends 51 of the male projections 34 will still engage the threads of the nut 29 keeping the nut 29 centered relative to the opening 27 as the nut rests on the floor. To re-attach the cover the male projections 34 are inserted back through the openings 27 and into the nut 29 such that the hooks 51 of the male projections will grippingly engage the threads of the nut 29 so that both the cover 32 and nuts 29 are secured in place. This removal and re-attachment can occur numerous times if needed.

Figure 11:
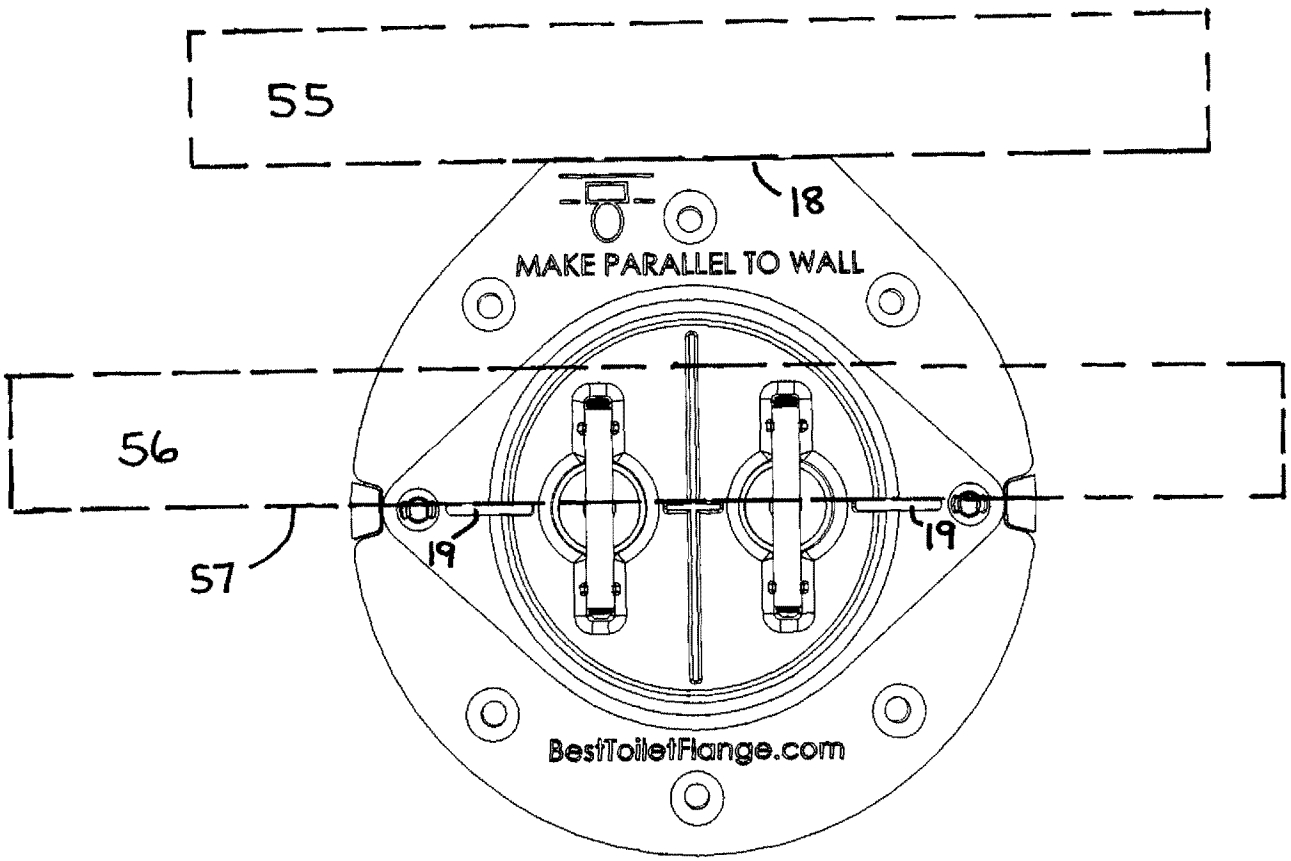
FIG. 11 is a top view of a toilet flange assembly with a pair of straight-edges abutted thereto.

The cover 32 is also formed with raised tabs 19 which are parallel to the back of a conventional toilet tank. The raised tabs 19 function as a pair of backstops onto which an extended straightedge (56; FIG. 11) may be abutted to confirm the parallel relationship of the flange assembly with the wall surface. The flange cover 32, by having the raised tabs 19 at the centerline, gives the installer, including the novice, a location onto which to hook a tape measurer and start the measurement such that the toilet flange is spaced the proper distance relative to any nearby walls or cabinetry.

The cover is preferably made of a plastic material and includes recesses 33 formed into the sides of the cover into which a screwdriver can be used to pry the cover 32 and removably detach it from the toilet flange 13. The recesses 33 are formed near the respective axial ends of the cover and in close proximity to respective projecting elements 34. The projecting elements 34 slide into respective bolt openings 27 and grippingly engage the threads of the respective rectangular nuts 29. The male projecting elements 34 are each formed with flexible gripping teeth with hook ends 51 which function to both secure the nuts 29 in place during shipping and keep the threads of the nut 29 clear of debris during the construction phase of the bathroom. The base of the projecting elements 34 closest to the underside of the cover is flared 35 so as to form a seal in the flared recessed portion 48 (FIG. 5) of the toilet bolt fastening opening 27. Furthermore, the cover is formed so that it extends radially about the respective projecting elements 34 by an area 36 to further keep construction debris from passing into the respective openings 27. The posts of the male projections 34 are flexible allowing the cover to be removed so that water can be added to the riser pipe for the performance of a rough-in plumbing test. The cover is then replaced for the duration of the test and removed again after 24 hours to confirm the water level did not change. The stagnated water level is one of the requirements to pass the rough-in plumbing test to verify no leakage has occurred in the system. After the test is completed the cover 32 is once again attached by inserting the projecting elements 34 into the openings 27 allowing the hook ends 51 to grip the threads or underside of the respective nuts 29. The cover will then remain attached during the completion of the finishing of the building and until the toilet is ready to be set.

The cover not only is designed to keep clean the threads of the toilet fastening bolt retaining nuts 29 but also to prevent any debris from passing into the riser pipe via the collar 22. The debris is prevented from entering the opening 21 in that the cover 32 completely overlies the opening 21 and is sealed relative to the sloped portion 23 of the opening via matching sloped portion 41 formed on the underside of the cover.

The cover 32 further functions as a unique storage area for necessary fastening elements. The central area of the cover includes two storage compartments for the respective sets of fasteners needed to secure the toilet to the flange. Each storage compartment includes a nut 40, washer 39, toilet fastening bolt 26 and brightly colored protective fitted sleeve 38. The nut 40 is positioned beneath the washer 39 wherein both the washer 39 and nut 40 are held in place by the toilet fastening bolt 26. The toilet fastening bolt 26 is removably secured by respective pairs of retaining tabs 42 formed within the cover 32. This is an extremely convenient location in that the plumber can readily see the fastening elements. The function of the respective sleeves 38 is two fold. The first function of the sleeve is to act as a protective sleeve to keep debris off of the threads of the toilet fastening bolts 26 since construction sites have several sticky substances such as joint compound, tile adhesive, tile grout and paint. The second function of the sleeves is to act as a guidance element so assist the toilet installer to align the openings in the base of the toilet with the upright toilet fastening bolts 26.

Figure 10:
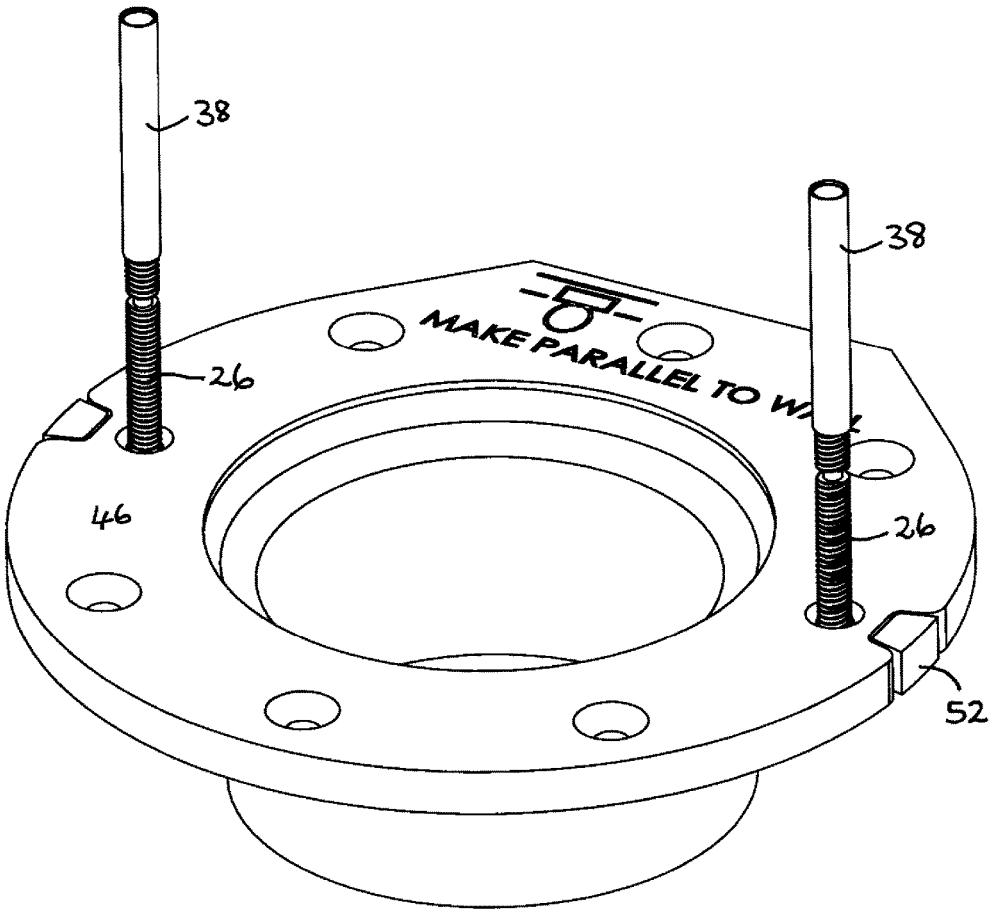
FIG. 10 is a perspective view with the fastening bolts inserted into the toilet flange and the sleeves extended providing guides for the toilet installer.

The fitted sleeves 38 are formed of a thin plastic or equivalent material, similar to a drinking straw, with an internal radial projection (not shown) that interacts with the threads of the fastener 26 so that the sleeve 38 is retained in place at any position as it is extended along the length of the fastener 26. This extension of the sleeve 38, as shown in FIG. 10, can more than double the effective axial length of the fastener assembly which in turn allows the installer to align the toilet base openings with the fasteners a greater distance from the floor. This is a significant advantage in that a conventional toilet needs a wax plumbing ring (not shown) to be installed between the base of the toilet and the top surface 46 of the toilet flange. The wax plumbing ring can sometimes be up to an inch in thickness making it such that the base of the toilet may contact the wax ring before the tips of the fastening bolts are properly aligned with the holes in the base of the toilet. This may require a new wax ring before the plumber proceeds in that a wax ring can be fractured by twisting. The extended sleeve solves this problem in that a sleeve 38 length of approximately two inches allows for the alignment of the tips of the sleeves with the toilet base openings at a height vertically spaced from the wax toilet ring. The sleeve 38 when fully extended from an upper end of the fastener 26 will essentially double the overall vertical height of the fastener assembly from approximately two inches (bolt 26 length) to four inches (including the sleeve 38). The conventional solution to the problem of aligning the fastening bolt with the hole in the toilet base was to make the fastening bolt extra long so that the hole in the toilet base is aligned with the toilet fastener before the base of the toilet contacts the sticky wax plumbing ring. In such an instance the installer must cut the excess fastener bolt to shorten it so that a conventional decorative cover (not shown) can be placed over the top of the nut and bolt and hide such for a more favorable finished appearance. The process of shortening the bolt is difficult to cut after the toilet has been installed since clearance between the bolt and the sides of the toilet is tight and clearance between elements within the bathroom such as walls and cabinets is also confined. A benefit of the sleeve 38 is that it is readily removed by simply pulling the pliable brightly colored sleeve 38 off the fastener 26 and disposing of it without the need of any additional tools or damage. The sleeves 38 are readily extended along the longitudinal axis of the fasteners 26 at the time of installation of the toilet. They are also brightly colored to assist the installer in locating them easily and aligning the openings in the base of the toilets with the tips of the extended sleeves 38. Thus the sleeve 38 is used at the time of toilet installation as a guide for the installer to assist in getting the fasteners 26 to align with the holes in the base of the toilet (not shown). The sleeves also provide a cost savings in that excess bolt length is eliminated in favor of the sleeve.

At the time of toilet installation the plumber will pry off the cover 32 for the last time from the toilet flange by inserting a screwdriver or similar device in the recesses 33. With the cover removed the installer will identify the toilet fastener bolts 26, which are covered by the protective sleeves 38. He will pry each bolt/sleeve past the retaining tabs 42 and then follow such by removing the respective washers 39 and nuts 40. With all the fastening elements removed the installer will slide the sleeve 38 along the length of the bolt 26 to an extended position such that the overall length of the bolt and sleeve combination will be essentially twice the length of the bolt 26 itself (FIG. 10). Alternatively, he can temporarily separate the sleeve 38 from the bolt 26 for later re-attachment. He will then align the end of the bolt 26 into the opening 27 and turn the bolt 26 until it is fully threaded through the nut 29 and continue until the end of the bolt 26 engages the upper surface of the floor 54. If the nut was loosened from the frictionally held position during installation it will be resting on the floor surface and trapped within the recess walls 47 with the assistance of the male projections 34. In this instance the installer will similarly thread the bolt 26 into the nut 29 at which time the nut 29 will travel vertically upward along the bolt 26 until the top surface of the nut 29 engages the bottom surface of the flange (FIG. 12). The bottom surface of the flange will thus act as a purchase 53 holding the bolt 26 firmly erect. The installer will then traditionally apply a wax ring to the toilet flange centering such about the opening 21 which forms the entrance to the riser pipe. With the wax ring (not shown) in place, the bolts 26 with the fully extended sleeves 38, stand erect to the toilet flange. The sleeves 38 are dimensioned to provide a slight interference fit with the bolt threads so that they can be positioned at any height and remain in position. Furthermore, the sleeves 38 are brightly colored to further benefit the toilet installer with a contrasting color to assist in aligning the openings in the base of the toilet with the erect bolt/sleeve structure. Since the sleeves are flexible the toilets are not chipped or damaged in any manner if the installer should hit the sleeves as he lifts the toilet base openings into alignment with the bolt/sleeves. The toilet is then lowered onto the flange along the bolt/sleeve until fully seated. The sleeves 38 are then merely slipped off the bolts and disposed of. This is followed by placing the respective washer 39 about the bolt and lastly threading the nut 40 onto the bolt and securing such in a proper manner to seat the toilet base against the floor.

Figure 9:
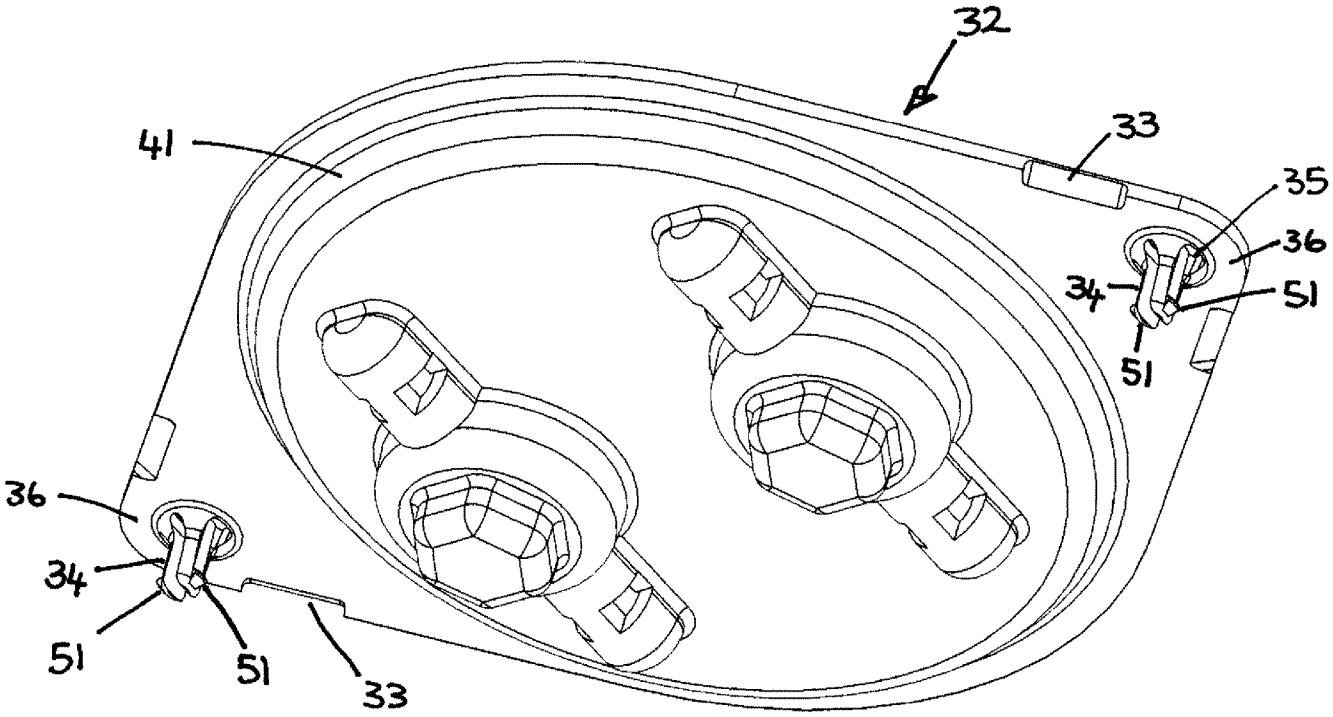
FIG. 9 is a bottom view of the toilet flange cover of FIG. 8.

The cover 32, as best seen in FIGS. 4, 8 and 9, includes geometric indicators 24/25 which intersect at the exact central axis of the cover which is also the central axis of the flange opening 21 which is also coaxial with the centerline of the riser pipe. Thus the cover, flange opening and riser pipe all share a common centerline axis. This is beneficial from the measuring standpoint. Each toilet has a distance to which it is designed to be spaced from a finished wall. It is from these lines that the distance can be measured from the front, back or either side. Of course the distance that will be measured the greatest amount of times is the distance from the centerline to the finished wall located behind the tank. The standard distance rear measurement is either twelve or fourteen inches. To make this exercise even easier when measuring to the common rear distance, the cover is provided with a pair of spaced tabs 19. The tabs 19 are raised a slight distance above the top surface plane of the cover 32 and perform two functions. First, the tabs are formed with a square edge in order for a measuring tape to grab. Secondly, the tabs form a backstop for a straightedge 56 to more clearly define a parallel orientation to a finished wall surface as shown in FIG. 11. This allows a builder or homeowner to quickly verify the measured distance before they select a toilet that is designed to fit. It also allows the plumber to confirm design distances before he permanently secures the flange to the riser. Thus, in addition to the straight surface 18 acting as a backstop for a straightedge 55, the benefit of using tabs 19 as a backstop as well is that an edge 57 of the straightedge 56 itself passes through the centerline of the toilet flange and thus can be measured from directly to verify the design distance.

It is noted that the toilet flange itself is symmetrically formed on either side of an axis (49, FIG. 5) that passes perpendicularly through the center of the surface 18. This is very beneficial in that a plumber can turn the flange upside down as a template on the floor and use the straight surface 18 as a measurement location instead of a rounded surface as with conventional flanges. Using a measuring tape from a straight surface is much easier that measuring from a rounded element. The six screw pattern 28 is symmetrical relative to the central axis 49 thus allowing those hole locations to be identified when the flange is turned upside down as a template.

I claim:

1. A toilet flange assembly for mounting a toilet to a floor and for connecting said toilet to a drain pipe leading to a waste pipe, said toilet flange assembly comprising a radial flange portion having a central axis, an outer perimeter of said radial flange portion being formed at a substantially constant radius from said central axis, the outer perimeter portion of said radial flange portion including a straight portion, said straight portion including a planar surface, said planar surface intersecting said constant radius at least at one point; wherein said radial flange portion has two circular openings into which respective toilet fastening bolts are inserted, each said opening having a central axis, said two openings being symmetrically spaced with respect to a plane and defining a length there between, said plane bifurcating said straight portion and being perpendicular thereto, said planar surface having a length less than said length defined between said two openings;

wherein said radial flange portion has an upper top surface and an opposite underside surface, wherein each said fastening bolt is secured to said toilet flange by a fastener, each said fastener being fixedly secured to said underside of said toilet flange in a recess prior the installation of the fastening bolt;

and wherein a height of said recess is greater than a height of said fastener.

2. The toilet flange assembly of claim 1 wherein at least three walls of said recess are in direct frictional contact with at least three sides of said fastener.

3. The toilet flange assembly of claim 1 wherein each said fastener recess is contiguously formed with a slot, said slot extending radially from said central axis of said radial flange portion, said radial flange portion has an outer perimeter wall, said outer perimeter wall having a frangible element at an outermost radial end of each said respective slot.

4. The toilet flange assembly of claim 1 including a cover, said cover having male projections that insert into said circular openings.

5. The toilet flange assembly of claim 4 wherein said radial flange portion has an upper top surface and an opposite underside surface, said underside surface frictionally retaining in place a pair of fasteners, each said frictionally held fastener having threads formed about a central thread axis, the central thread axis of each said fastener being coaxial with the central axis of each said circular opening, each said male projection mechanically securing a respective said fastener to said underside surface.

6. The toilet flange assembly of claim 4 wherein said cover includes at least one storage compartment, said storage compartment mechanically retains at least one nut threaded fastening element.

7. The toilet flange assembly of claim 4 wherein said cover includes a backstop, said backstop having a straight surface which is parallel to said straight portion.

8. The toilet flange assembly of claim 5 wherein said male projection mechanically secures said fastener by including a hook type end which engages an underside of the fastener.

9. The toilet flange assembly of claim 7 wherein a plane that includes the straight surface of said backstop passes through the central axis of said radial flange portion.

10. A toilet flange assembly for mounting a toilet to a floor, said toilet flange assembly comprising a radial flange portion having a top surface and an underside surface and having a central round opening through which waste will flow, said radial flange portion including openings through which securing elements pass to secure the radial flange to said floor and circular openings for toilet fastener bolts, a recess centered under each said circular opening and formed on the underside of said flange, each said recess defined by walls, said walls frictionally retaining a threaded fastener beneath said flange prior the installation of the toilet fastener bolts.

11. A toilet flange assembly of claim 10 wherein at least three walls of said structural ribs are in direct frictional contact with at least three sides of said threaded fastener.

12. The toilet flange assembly of claim 10 wherein the height of each said threaded fastener is less than the height of said recess such that said threaded fastener when in contact with the underside of said flange is spaced from the floor onto which the toilet flange is secured.

13. A toilet flange assembly for mounting a toilet to a floor, said toilet flange assembly comprising a radial flange having a central round opening through which waste will flow, a pair of toilet fastener bolt openings in the radial flange, a unitary cover having a substantially flat upper surface and being secured to a top surface of said radial flange portion and completely blocking said central round opening, a respective fastener being fixedly secured to the underside of the toilet flange and centrally located in each fastener bolt opening, said unitary cover removably resecurable to said radial portion by male projections formed as part of said unitary cover which are inserted into said toilet fastener bolt openings, said male projections including gripping elements which fixedly secure said fasteners.

14. A toilet flange assembly of claim 13, wherein said unitary cover has formed thereon raised planar tab elements which are formed parallel to a line which passes through said bolt openings when said unitary cover is secured to said radial flange, said tab elements extending upwardly from said substantially flat upper surface to provide backstops for a straightedge.

15. The toilet flange assembly of claim 13 wherein said unitary cover includes at least one storage compartment, said storage compartment retains at least one fastening element.

16. The toilet flange assembly of claim 15 wherein said fastening element is a fastening bolt and wherein the storage compartment also stores a sleeve which keeps the threads of the bolt clear of debris during storage of said bolt.

17. A fastening assembly for a toilet flange consisting of at least one threaded bolt having an outer diameter and an extendable flexible sleeve having an inner diameter essentially equal to the outer diameter of said bolt, said flexible sleeve having essentially the same length as the bolt, said flexible sleeve being slidably fitted to said bolt such that when said flexible sleeve is slidably extended longitudinally relative to said bolt it maintains said position at any distance along said extension.

* * * * *